United States Patent [19]

Peters

[11] Patent Number: 4,706,880

[45] Date of Patent: Nov. 17, 1987

[54] SIGNALING MAILBOX

[76] Inventor: Lloyd D. Peters, 2251 Presley Dr., Grove City, Ohio 43123

[21] Appl. No.: 860,852

[22] Filed: May 8, 1986

[51] Int. Cl.[4] ..... B65D 91/00

[52] U.S. Cl. ..... 232/35

[58] Field of Search ..... 232/35, 37

[56] References Cited

U.S. PATENT DOCUMENTS

| | | | |
|---|---|---|---|
| 3,026,025 | 3/1962 | Hanson | 232/35 |
| 3,675,845 | 7/1972 | Scheerer | 232/35 |
| 3,958,752 | 5/1976 | Pieszchala | 232/35 |
| 4,066,209 | 1/1978 | Brake | 232/35 |
| 4,073,430 | 2/1978 | Joris | 232/35 |

*Primary Examiner*—Robert P. Swiatek

*Attorney, Agent, or Firm*—Robert B. Watkins

[57] ABSTRACT

A rural mailbox structure including a "mails-in" signaling element that is operable to protrude laterally sideways and be visually apparent from the front and or rear when the mailbox is opened by rotation of the front door. Apparatus is included to maintain the signal element in the cocked unobservable position by a trigger rod engaged in an aperture in the signal element, which is disengaged when the front door is opened.

4 Claims, 3 Drawing Figures

SIGNALING MAILBOX

FIELD OF THE INVENTION

This invention relates to a mailbox. More particularly, it relates to the type of receptacle for mail that is used most commonly in rural and suburban situations where mail is deposited in the box, which is located at the edge of the street, by a postman traveling from residence to residence in an automobile or similar vehicle.

BACKGROUND OF THE INVENTION

Mailboxes of the "rural" type are fastened on the top or side of a post which suspends the container at a vehicle window level position beside the street. The mail carrier drives into position beside the box, opens the box door, deposits the mail in the box from the front, closes the box door and drives to the next mailbox. If the resident has placed outgoing mail in the box prior to the time that the mail carrier arrives, the mail carrier takes out the outgoing mail before placing the incoming mail in the box.

Because the function of the rural mailbox has a significant effect on the operation of the letter carrier, and the efficiency of the pickup and delivery operation at the mailbox site, the United States Postal Service Government Agency prescribes many of the features of the construction of the rural mailbox by means of rules and regulations. Consequently there is a substantial amount of uniformity in construction of rural mailboxes although there are a variety of manufacturers and different styles available, and in use.

Among the prescribed features is that the front door must be hinged at the bottom and opened downward. Another requirement is that the mailbox be provided with a movable flag on the right side, usually in the form of a metal pendant shaped member.

This flag is for the purpose indicating to mail carrier that the resident has placed "out-going" mail in the box that the resident wishes to be taken by the mail carrier to the post office. The indication is given by the resident, who raises the flag to a vertical position at the time that the outgoing mail is placed in the box. By this means the mail carrier will know that he or she should stop even though there is not any "incoming" mail to put in the box. The regulations provide for the type of hasp on the front door and the means of mounting, etc.

The regulations do not prescribe nor recognize a common problem in the use of rural mailboxes which users have known for many years. Although the flag provides a means to signal to the mail carrier that there is mail to be picked up, the resident receives no signal that mail has been deposited in the box. Therefore, the common practice is to either watch for the mail carrier from the residence and/or come out from the residence to the mailbox to look in and see if there is any incoming mail. This process of "checking" the mailbox is inconvenient, time and energy consuming, and inclement weather may even be unhealthy.

Therefore, there has been a recognized need for a mailbox having a provision to indicate to the resident that the mail carrier has been to the box and opened the box with a presumption that incoming mail has been placed in the box. This "mails-in" signal has been provided in various ways of the prior art.

Numerous inventions have been made and patented in the field of rural mailboxes. Some of these have been directed to solving the problem of providing an indication that the box has been opened by the mail carrier and that there may be incoming mail in the box.

U.S. Pat. No. 4,437,607 Negosta shows a rural mailbox having a window in an enclosure on the back of the box. The window changes color when activated by release of a spring biased rod within the box. The rod presses against the door in the closed position and is relieved by the opening of the front door. The signal panel rotates into position in the window on the back of the box when the rod disengages from the panel.

U.S. Pat. No. 4,318,507 Thopsey et al. reveals a mail arrival flag system in which an external flag on the rear of the box rotates to a vertical position under influence of a counter weight when released by a wire that is activated by the opening of the front door. The wire is fastened to the door and pulled out of engagement with the signal element when the door is opened. When the signal element has been activated it is in a vertical position.

U.S. Pat. No. 3,606,141 Taylor shows a rotary signaling vane which is housed in a transport enclosure. When activated by the opening of the front door on the mailbox the vane turns from the askew "cocked" position to a vertical position in the transparent window under the influence of a weight on an arm of the vane member.

U.S. Pat. No. 3,194,491 Parker reveals a mailbox with a signaling device in which a signal element rotates 180° under the influence of a counter weight when a rod in the upper portion of the mailbox is released by the opening of the front door. The signal element has a flag portion which is transverse to the back of the box and a second signal element which is parallel to the back of the box when the signal element rotates 180° these signal elements change from the upper position to the lower position or vice versa and the change in position is recognizable from the side view and from rear view.

U.S. Pat. No. 3,026,025 Hanson is an earlier patent showing a rotary signal element on the back of a mailbox which falls in rotation from an upper cocked position to a lower released position when released by a rod that moves transversely in the upper area inside the box.

One primary disadvantage of the patents in the prior art which have been directed to the feature of providing a signal when the "mails-in", i.e. the box has been opened, is that the signal elements are positioned in substantially a vertical position and within the plane of the sides of the box in the released and positive indication position. With the signal element in this position it is invisible when the mailbox is mounted in any way where there is an obstruction to the view of the rear of the box. If the mailbox post sticks up above the top of the mailbox in the mounted position (or if the mailbox is mounted on a wall that sticks up above the box) the signal can not be seen because it is hidden from view. Since many mailboxes are mounted in one of these positions such prior art mailboxes are limited in their use. The number of mountings with the back of the box hidden is not infrequent.

In addition, many prior mailboxes having a "mails in" feature are very complicated in construction, requiring a large number of extra parts for the mailbox and extra operations in the assembly procedures. Many of these prior art boxes have operating positions inside the box that interfere with the mail.

DISCLOSURE OF THE INVENTION

It is an object of this invention to provide an improvement in the "mails-in" signaling devices on rural mailboxes by providing a signal element that protrudes from the sides or protrudes beyond the sides i.e. outside of the plane of the sides of the box. By conceiving the means of providing the visual signal at the sides, the disadvantages of the prior art devices is overcome and the visual signal is perceptable even though the back of the box is hidden by a post and that the post extends above the top of the box.

Also the mails is signal is visable from the front of the box which is an important advantage. This is important when the mail box is positioned across the street from the resident, and this is often the case; so that the mail carrier only has to drive down one side of the street.

In summary, the invention comprises:

In a mailbox having a front end with an opening for the deposit and retrival of mail from the street and a rear end facing away from the street, opposite sides between the front and rear ends, and including a top protection from the elements and a bottom for support of and positioning of the mailbox, the improvement comprising means for providing a signal that is visually perceptable from the front and/or rear of the mailbox indicating that the front door of the mailbox has been opened.

Additionally, this invention includes:

A rural mailbox comprising a structure having lateral side elements and upper top portion, a bottom panel element, a rear element, and rotatable front door, (b) an enclosure/housing means mounted on the rear element of the structure, (c) a signal element rotatably mounted in the enclosure member, operable from a cocked upper position within the planes of the side elements while maintained in position by a trigger rod engaged in an aperature in the signal element to a second visible more lateral position beyond the plane of the side elements of the structure when the trigger rod is released from engagement in the aperature of the signal element, by the rotatable opening of the front door.

The foregoing and other advantages of the invention will become apparent from the following disclosure in which a preferred embodiment of the invention is described in detail and illustrated in the accompanying drawings. It is contemplated that variations in structural features and arrangement of parts may appear to the person skilled in the art, without departing from the scope or sacrificing any of the advantages of the invention.

BEST MODE OF CARRYING OUT THE INVENTION

Figure 1:
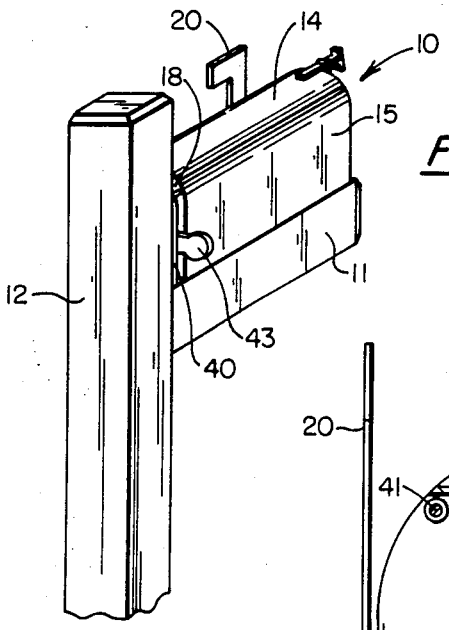
FIG. 1 is a perspective view of the mailbox of this invention mounted on a post having a protrusion above the top at back side of the mailbox.
Figure 3:
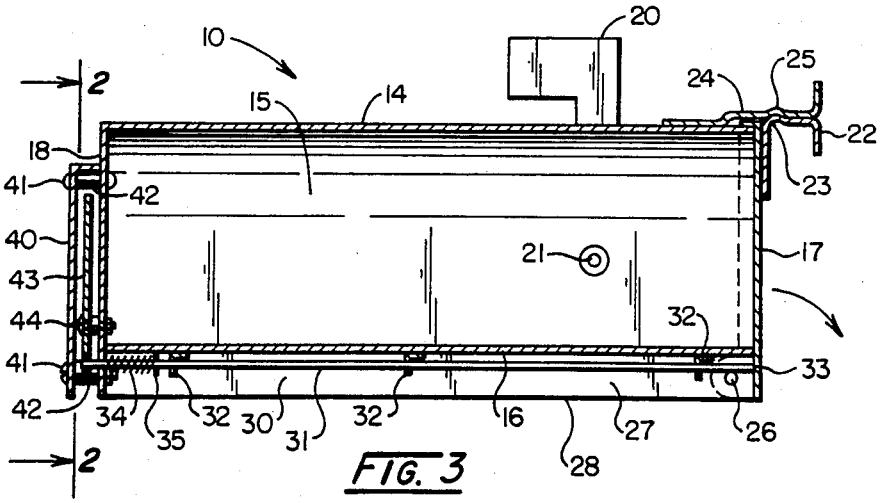
FIG. 3 is a cross sectional view longitudinally through the center line of the mailbox, taken on the line 3—3 of FIG. 2.

Referring to FIGS. 1 and 3, a mailbox 10 is mounted on an arm 11 that is supported on a post 12 which is affixed to the ground or other support structure. The mailbox 10 includes a top portion 14, side portions 15, a bottom panel 16, as well as a front door 17 and a rear panel 18. A flag member 20 is rotatively mounted on a pivot element 21, such as a rivet or screw. When in the upper vertical position shown, the flag 20 indicates to an approaching mail carrier that the resident has deposited outgoing mail in the box, and the mail carrier should stop and retrive it from the box, irrespective of whether the mail carrier has mail for delivery to the resident.

Normally when the flag 20 is rotated 90° or further to a horizontal or lower position the signal means to opposite effect, that is, there is no need for the mail carrier to stop unless he or she has mail to be delivered to resident and owner of the box.

The front door 17 is provided with a formed lower clip 22 having a detent 23. The clip 22 is mounted on the front face of the door 17. The front upper portion 14 of the mailbox 10 is provided with a second clip 24 having a detent 25 that is configured to mate with the lower detent 23. When it is desirable to open the door 17, the lower clip 22 provides a convenient handle for the mail carrier or the resident owner to pull the detent 23 from engagement in the detent 25, rotating the door in the direction of the arrow shown in FIG. 3.

The door 17 pivots on a rivet 26, or other means, passing through an apron 27 of the side 15.

The floor panel 16 is mounted at a position above a lower edge 28 of the apron 27 providing a recess 30 in which is mounted a horizontally movable trigger rod 31 that is supported from the floor panel 16 in one or more brackets 32. At a forward end 33, the door 17 presses against the trigger rod 31 in the closed position.

In the recess 30, a resilient means 34, such as a spring, is biased against a cotter pin 35 that is fixed to the trigger rod 31 at one end. At the opposite end the resilient means 34 presses against the rear panel 18 of the box 10. A rear most bracket 32 is positioned to act as a dead stop for cotter pin 35 when door 17 is opened to minimize the protrusion of trigger rod 31 at the front end.

Mounted on the back panel 18, an enclosure/housing 40 is supported and positioned by a fastener means 41, which may comprise screws and spacers 42.

A signal element 43 is pivotally mounted on the back panel 18 by a screw and nuts 44, or other suitable means. Shown in FIG. 2 this signal element 43 is provided with apertures 45 at an oblique angle on opposite sides of a center line 46 longitudinally through the length. At the opposite end the signal element 43 is provided with an enlarged bulbous portion 47.

Figure 2:
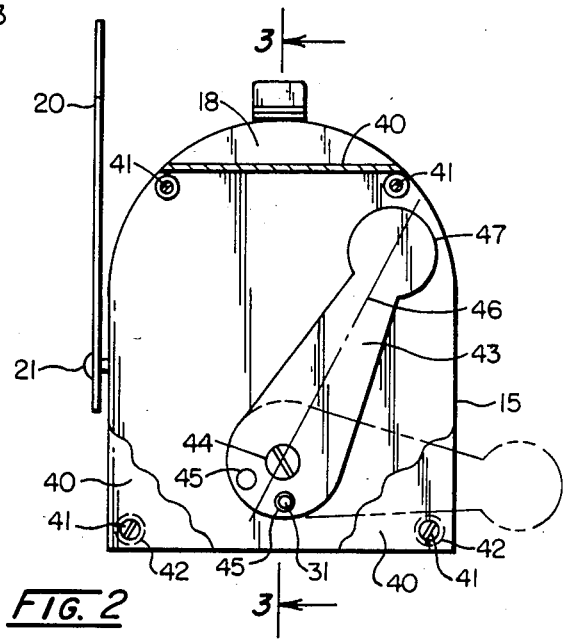
FIG. 2 is a rear view of the mailbox of this invention with a portion of an external enclosure member removed, taken along the line 2—2 of FIG. 3.

In the cocked position, shown in FIG. 2 signal element is maintained in its semi-vertical position by the insertion of an end of the trigger rod 31 in one of the apertures 45.

In operation, when the door 17 is opened the end of the rod 33 is released from contact with the door and the trigger rod 31 is moved in translation away from the rear panel 18 under the influence of the spring 34. The cotter pin 35 stops trigger rod 31 when spring 34 causes cotter pin 35 to contact rear most bracket 32 to minimize end of rod 33 protrusion when door 17 has been opened. The opposite end of the trigger rod 31 moves out of the aperture 45 releasing the signal element 43 and allowing it to swing in rotation by its own weight to the position shown in FIG. 1 and to the position shown by the dashed lines in FIG. 2. In the position shown the enlarged bulbous portion of 47 of the signal element 43 protrudes sideways from the side plane of the mailbox, and falls outside the plane of the side panel 15. In this "mails-in" signaling position the signal element is clearly visible from the front and/or rear of the mailbox even though the mounting post protrudes behind and above the rear panel 18 and enclosure 40 of the mailbox. By this means it is visible by the owner from within the residence, whether it is on either side of the street making it unnecessary to go out to the mailbox to determine if there is any incoming mail in the box. To cock the signal element, after opening box door and retrieving mail from box, it is only necessary to hold the signal element in home position and close the box door, the signal is then reset for the next mail delivery.

The apparatus of this invention is quite simple, requiring only a minimum number of simply stamped parts and inexpensive fastening members such as screws. The apparatus is versatile in that it can be operated equally well from either side of the mailbox since it can be cocked to either side by engaging the end of the trigger rod 31 in the opposite aperature 45. If the device is cocked in the opposite direction, the signal element 43 will fall in the opposite direction when the door 17 is opened and the visual signal will appear on the other side of the mailbox.

It will be seen that the mailbox apparatus of this invention is simple, versatile, inexpensive, and effective to overcome the problems inherent in the prior art apparatus. In addition the apparatus of this invention complies with the rules and regulations of U.S. Postal Service without complicated encumbrances of any kind.

If it is necessary to mount the mailbox 10 on an arm protruding from a post, such as that shown in FIG. 1 it can be supported on auxiliary blocks (not shown) or other means such as a metal mounting bracket commonly sold for this purpose placed in the recess 30 leaving room for the operation of the trigger rod 31.

It is herein understood that although the present invention has been specifically disclosed with a preferred embodiment and examples, modifications and variations of the concepts herein disclosed may be resorted to by those skilled in the art. Such modifications and variations are considered to be within the scope of the invention and the appended claims.

I claim:

1. In a mailbox having a front end with an opening for the deposit and retrieval of mail from the street and a rear end facing away from the street, opposite sides between the front and rear ends, and including a top for protection from the elements and a bottom for support of and positioning of the mailbox, the improvement comprising:

means for providing a signal that is visible at a selected side from the front and/or rear of the mailbox indicating that the front door of the mailbox has been opened, said signal means including an element that moves from an unexposed hidden position within the planes of the sides of the mailbox to a visually exposed position beyond the planes of the sides of the mailbox, with the signal element rotatively supported within an enclosure on the rear end of the mailbox.

2. A mailbox according to claim 1 wherein the signal element is maintained in the enclosure by engagement with a trigger rod that is held in position by the front door of the mailbox and is released when the front door is opened allowing the signal element to rotate to a selected lateral visible position at either selected side of the mailbox and visible at the selected side.

3. A rural mailbox comprising:

a. a structure having lateral side elements and upper top portion, a bottom panel element, a rear element, and rotatable front door, b. a signal element rotatably mounted in an enclosure member on the rear element of the mailbox, operable from a cocked upper position within the planes of the side elements while maintained in position by a trigger rod engaged in an aperture in the signal element to a second visible more lateral position beyond the plane of one of the side elements of the structure when the trigger rod is released from engagement in the aperture of the signal element, by the rotatable opening of the front door.

4. A rural mailbox according to claim 6 wherein the second visible more lateral position of the signal element is selected to be more visible beyond the plane of a previously selected side element of a previously selected side of the mailbox.

* * * * *